US008939133B2

(12) United States Patent
Agemura

(10) Patent No.: US 8,939,133 B2
(45) Date of Patent: Jan. 27, 2015

(54) OUTBOARD MOTOR

(75) Inventor: Kazuyuki Agemura, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 400 days.

(21) Appl. No.: 13/447,375

(22) Filed: Apr. 16, 2012

(65) Prior Publication Data

US 2012/0298082 A1 Nov. 29, 2012

(30) Foreign Application Priority Data

May 24, 2011 (JP) ..... 2011-115757

(51) Int. Cl.

| | |
|---|---|
| ***H01F 38/12*** | (2006.01) |
| ***F02P 15/00*** | (2006.01) |
| ***B63H 20/00*** | (2006.01) |
| ***F02P 3/02*** | (2006.01) |
| ***F02B 61/04*** | (2006.01) |

(52) U.S. Cl.

CPC ..... *F02P 3/02* (2013.01); *F02B 61/045* (2013.01); *F02P 15/001* (2013.01); *B63H 20/00* (2013.01); *F02D 2400/21* (2013.01)

USPC ..... 123/634; 123/633

(58) Field of Classification Search

CPC ..... B63H 20/00; F02D 2400/22; F02P 15/00

USPC ..... 123/634

See application file for complete search history.

(56) References Cited

U.S. PATENT DOCUMENTS

| | | | | |
|---|---|---|---|---|
| 5,180,313 | A * | 1/1993 | Brandt | 439/125 |
| 6,257,188 | B1 * | 7/2001 | Fujii et al. | 123/90.38 |
| 6,513,504 | B2 * | 2/2003 | Ikuma | 123/509 |
| 7,021,979 | B2 * | 4/2006 | Yazaki et al. | 440/88 A |
| 7,104,234 | B2 * | 9/2006 | Suzuki et al. | 123/143 C |
| 2001/0032636 | A1 * | 10/2001 | Morganti et al. | 123/633 |
| 2002/0166543 | A1 * | 11/2002 | Ikuma | 123/508 |
| 2003/0127080 | A1 * | 7/2003 | Sexton | 123/634 |
| 2003/0200959 | A1 * | 10/2003 | Wada | 123/635 |
| 2004/0229528 | A1 * | 11/2004 | Yazaki et al. | 440/88 A |
| 2005/0042949 | A1 * | 2/2005 | Tawa et al. | 440/88 C |
| 2005/0166882 | A1 * | 8/2005 | Suzuki et al. | 123/143 C |
| 2012/0298082 | A1 * | 11/2012 | Agemura | 123/634 |
| 2013/0061834 | A1 * | 3/2013 | Inoue et al. | 123/634 |

FOREIGN PATENT DOCUMENTS

| | | | |
|---|---|---|---|
| EP | 0 329 188 | A2 | 8/1989 |
| JP | 56-88272 | A | 7/1981 |
| JP | 59-034483 | A | 2/1984 |

(Continued)

OTHER PUBLICATIONS

Machine translation of JP2008078607 Apr. 3, 2008.*

*Primary Examiner* — Hieu T Vo
*Assistant Examiner* — Arnold Castro
(74) *Attorney, Agent, or Firm* — Keating & Bennett, LLP

(57) ABSTRACT

An outboard motor includes an engine and a casing. The engine includes a cylinder unit, ahead cover and an ignition coil device. The cylinder unit is made of metal. The head cover is made of resin and is attached to the cylinder unit. The ignition coil device is attached to the head cover. The casing is made of resin and covers the engine. The coil ignition device includes a radiated noise reducer portion. The radiated noise reducer portion is configured to reduce noise that is radiated from the ignition coil device.

6 Claims, 14 Drawing Sheets

(56) References Cited

FOREIGN PATENT DOCUMENTS

| | | | |
|---|---|---|---|
| JP | 01-211807 | A | 8/1989 |
| JP | 06-147083 | A | 5/1994 |
| JP | 2001-199392 | A | 7/2001 |
| JP | 2002-332928 | A | 11/2002 |
| JP | 2004-208429 | A | 7/2004 |
| JP | 2004-259605 | A | 9/2004 |
| JP | 2008-078607 | A | 4/2008 |

* cited by examiner

OUTBOARD MOTOR

CROSS-REFERENCE TO RELATED APPLICATIONS

This application claims priority to Japanese Patent Application No. 2011-115757 filed on May 24, 2011, the entirety of which is hereby incorporated by reference in its entirety.

BACKGROUND OF THE INVENTION

1. Field of the Invention

The present invention relates to an outboard motor.

2. Description of the Related Art

Outboard motors recently have been embedded with a number of electronic devices such as an ECU (Engine Control Unit) for controlling an engine and a digital meter for displaying a variety of information such as speed. Further, the outboard motors accommodate a battery cable for supplying electric power from a battery to the electronic devices and a wiring harness for transmitting electric signals among the electronic devices.

Meanwhile, an attempt to use a resin head cover instead of a metal head cover has been underway to reduce the weight of the outboard motor engine, as described in Japan Laid-open Patent Application Publication No. JP-A-2001-199392.

The aforementioned electronic devices normally radiate noise. Noise radiated from a given electronic device may have a negative impact on controls of the other electronic devices. Therefore, countermeasures are desirably executed for reducing the noise. In general, noise radiated from the electronic devices is reduced by grounding or shielding the electronic devices by metal members. Therefore, using a resin component for the engine goes against the noise reduction countermeasures although it is effective from the perspective of weight reduction of the engine.

Now, the outboard motor normally includes a resin casing for covering the engine. Therefore, a noise reduction effect cannot be expected in the outboard motor unlike a metal hood of an automobile.

SUMMARY OF THE INVENTION

Preferred embodiments of the present invention provide an outboard motor include a resin head cover and a resin casing to reduce noise.

An outboard motor according to a preferred embodiment of the present invention includes an engine and a casing. The engine includes a cylinder unit, a head cover and an ignition coil device. The cylinder unit is made of metal. The head cover is made of resin and is attached to the cylinder unit. The ignition coil device is attached to the head cover. The casing is made of resin and covers the engine. The ignition coil device includes a radiated noise reducer portion. The radiated noise reducer portion is configured to reduce noise to be radiated from the ignition coil device.

The inventor of the present invention discovered that the ignition coil device was a potential source of noise that has a very significant negative impact on electronic devices in the outboard motor including a resin head cover and a resin casing. According to the outboard motor of the present preferred embodiment of the present invention, the radiated noise reducer portion, provided for the ignition coil device, reduces noise radiated from the ignition coil device. Therefore, reduction of radiated noise can be achieved in the outboard motor including the resin cover and the resin casing.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
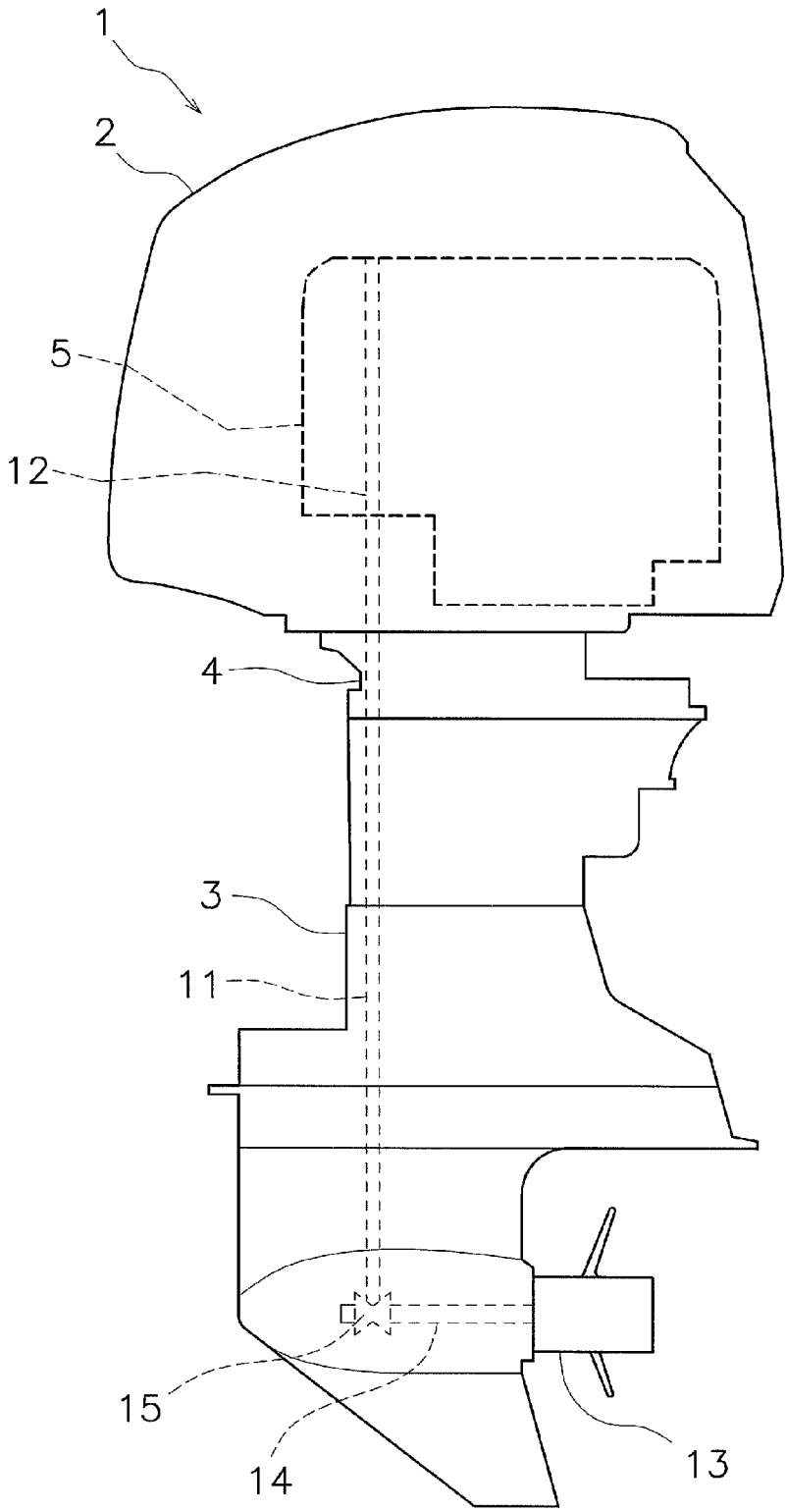
FIG. 1 is a side view of an outboard motor according to a preferred embodiment of the present invention.

An outboard motor according to preferred embodiments of the present invention will be hereinafter explained. FIG. 1 is a side view of an outboard motor 1 according to a preferred embodiment of the present invention. The outboard motor 1 includes a top casing 2, a bottom casing 3, an exhaust guide 4 and an engine 5. The top casing 2, the bottom casing 3 and the engine 5 are fixed to the exhaust guide 4. The top casing 2 is made of resin. The top casing 2 is an example of a casing of a preferred embodiment of the present invention. The exhaust guide 4 is made of metal such as aluminum alloy, for example. The bottom casing 3 is made of resin.

The engine 5 is disposed within the top casing 2. In other words, the top casing 2 covers the engine 5. The engine 5 includes a crankshaft 12. A drive shaft 11 is disposed within the bottom casing 3. The drive shaft 11 is disposed within the bottom casing 3 along a vertical (up-and-down) direction. The drive shaft 11 is coupled to the crankshaft 12 of the engine 5. Further, a propeller 13 is disposed in the lower portion of the bottom casing 3. The propeller 13 is disposed below the engine 5. Yet further, a propeller shaft 14 is coupled to the propeller 13. The propeller shaft 14 is disposed along a longitudinal (back-and-forth) direction of the outboard motor 1. The propeller shaft 14 is coupled to the bottom end of the drive shaft 11 through a bevel gear 15.

In the outboard motor 1, driving force generated by the engine 5 is transmitted to the propeller 13 through the drive shaft 11 and the propeller shaft 14. Accordingly, the propeller 13 is configured to be forwardly or reversely rotated. Rotation of the propeller 13 generates propulsion force for forwardly or backwardly moving a vessel body embedded with the outboard motor 1.

Figure 2:
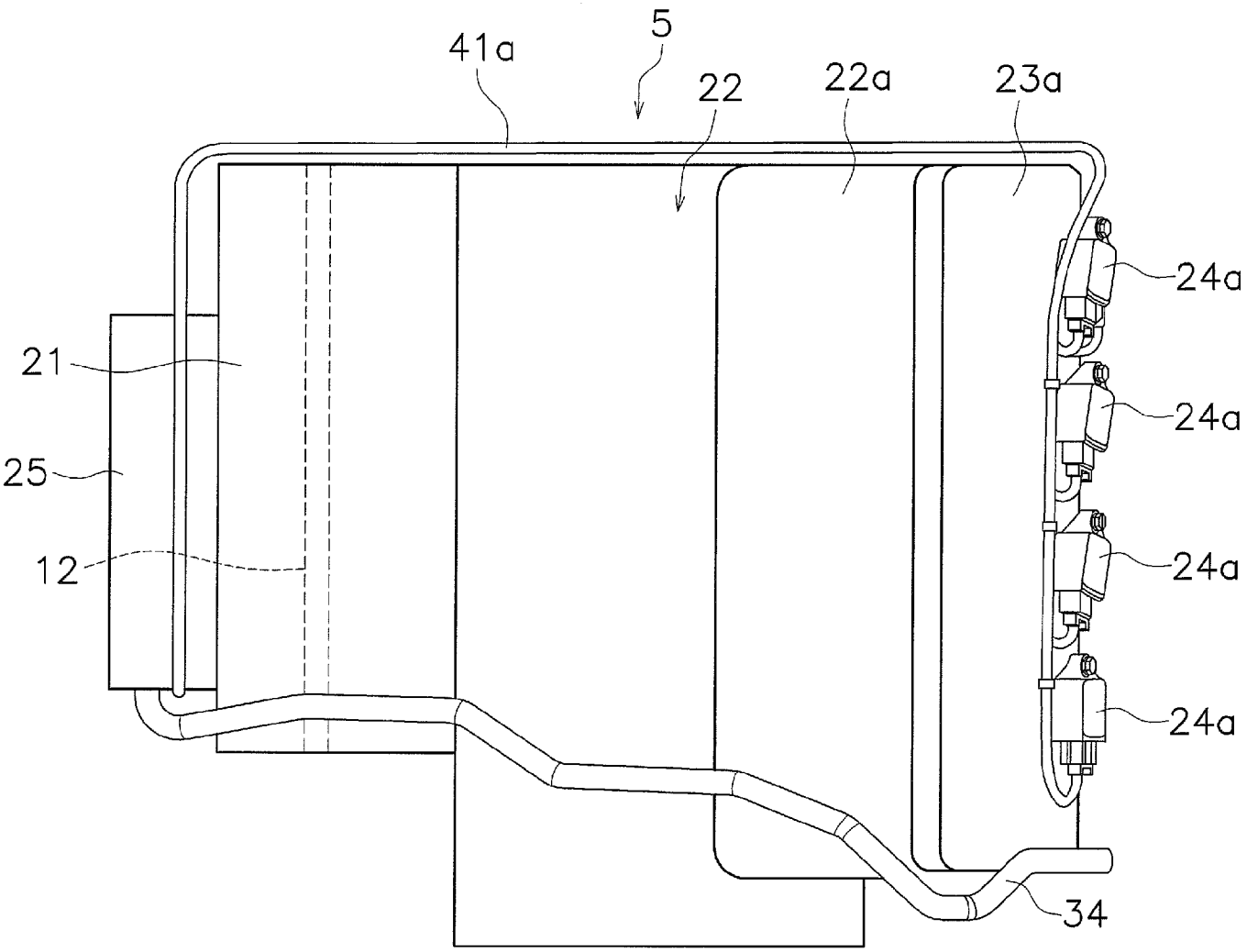
FIG. 2 is a side view of an engine of the outboard motor.
Figure 3:
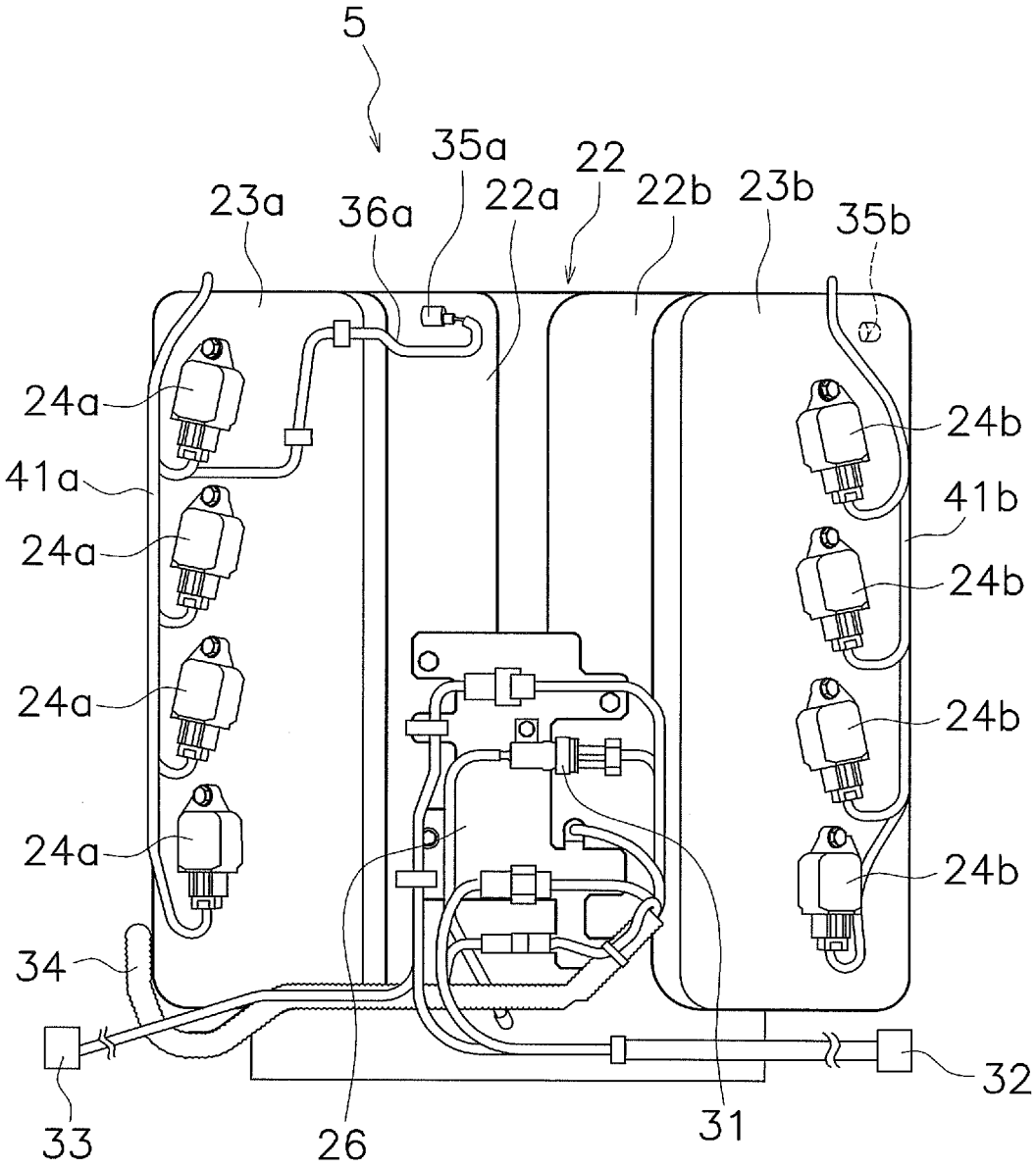
FIG. 3 is a rear view of the engine.

Next, the structure of the engine 5 will be hereinafter explained in detail. FIG. 2 is a schematic side view of the engine 5, whereas FIG. 3 is a schematic rear view of the engine 5. It should be noted in the following explanation of the engine 5 that the term "front" and its related terms refer to a travel direction of the vessel body embedded with the outdoor motor 1. In other words, a direction correspond to "left" in FIG. 2 will be referred to as "front" in the explanation of the engine 5. On the other hand, direction corresponding to "right" in FIG. 2 will be referred to as "rear" in the explanation of the engine 5. Further, a direction corresponding to "left" in FIG. 3 will be referred to as "left" in the explanation of the engine 5. On the other hand, a direction corresponding to "right" in FIG. 3 will be referred to as "right" in the explanation of the engine 5.

The engine 5 includes a crankcase 21, a cylinder unit 22, head covers 23*a* and 23*b*, a plurality of ignition coil devices 24*a* and a plurality of ignition coil devices 24*b*. The crankcase 21 is made of metal such as aluminum alloy, for example. The crankcase 21 accommodates the crankshaft 12. The crankshaft 12 is extended in the vertical direction. As illustrated in FIG. 2, an ECU (Engine Control Unit) 25 is attached to the front surface of the crankcase 21. In other words, the ECU 25 is attached to the front surface of the engine 5. The ECU 25 is configured to control an operation of the engine 5 based on information received from a sensor to be described.

The cylinder unit 22 is made of metal such as aluminum alloy, for example. The cylinder unit 22 is fixed to the exhaust guide 4. The engine 5 is so-called a V engine, and the cylinder unit 22 includes a pair of a first cylinder portion 22*a* and a second cylinder portion 22*b* combined in a V-shape. The first cylinder portion 22*a* is obliquely extended leftwards and rearwards, whereas the second cylinder portion 22*b* is obliquely extended rightwards and rearwards. The first cylinder portion 22*a* includes a plurality of cylinders (not illustrated in the figures). Each cylinder of the first cylinder portion 22*a* accommodates a piston (not illustrated in the figures). Likewise, the second cylinder portion 22*b* includes a plurality of cylinders (not illustrated in the figures). Each cylinder of the second cylinder portion 22*b* accommodates a piston (not illustrated in the figures). In the present preferred embodiment, the first cylinder portion 22*a* preferably includes four cylinders, for example. Likewise, the second cylinder portion 22*b* preferably includes four cylinders, for example. Therefore, the cylinder unit 22 herein preferably includes totally eight cylinders and eight pistons, for example.

The head covers 23*a* and 23*b* are attached to the cylinder unit 22. Each of the head covers 23*a* and 23*b* is made of resin. The head covers 23*a* and 23*b* will be hereinafter referred to as a first head cover 23*a* and a second head cover 23*b*. The first head cover 23*a* is attached to the first cylinder portion 22*a*, while the second head cover 23*b* is attached to the second cylinder portion 22*b*. Specifically, the first head cover 23*a* is attached to the rear surface of the first cylinder portion 22*a*, while the second head cover 23*b* is attached to the rear surface of the second cylinder portion 22*b*.

As illustrated in FIG. 3, a cable attachment member 26 is attached to the rear surface of the engine 5. The cable attachment member 26 is a plate member disposed between the first cylinder portion 22*a* and the second cylinder portion 22*b*. A variety of distribution cables are attached to the cable attachment member 26 to electrically connect a plurality of electronic devices to each other. Specifically, distribution cables to connect the ECU 25 and a variety of sensors are attached to the cable attachment member 26. Further, distribution cables to connect the ECU 25 and a variety of switches are attached to the cable attachment member 26. For example, the sensors herein include a water pressure sensor 31 and a speed sensor 32. The water pressure sensor 31 is attached to the cable attachment member 26. The water pressure sensor 31 is configured to detect water pressure. On the other hand, the speed sensor 32 is disposed on the outside of the outboard motor 1. The speed sensor 32 is configured to detect the speed of the vessel body embedded with the outboard motor 1. For example, the switches herein include a PTT (Power Tilt and Trim) switch 33. The PTT switch 33 is disposed on the outside of the outboard motor 1. The PTT switch 33 is a type of switch used to operate a tilt function and a trim function of the outboard motor 1. The various sensors and switches are connected to the ECU 25 through a wiring harness 34. The wiring harness 34 is extended from the cable attachment member 26 and passes below the first cylinder portion 22*a*. Further, the wiring harness 34 is disposed to pass sideward of the engine 5, as illustrated in FIG. 2. Thus, the wiring harness 34 is extended forwards and connected to the ECU 25.

Further, as illustrated in FIG. 3, a first cam angle sensor 35*a* is attached to the first cylinder portion 22*a*. The first cam angle sensor 35*a* is configured to detect the rotational angle of a cam shaft of the first cylinder portion 22*a*. More specifically, the first cam angle sensor 35*a* is attached to one of the lateral surfaces of the first cylinder portion 22*a*. The first cam angle sensor 35*a* is disposed between the first cylinder portion 22*a* and the second cylinder portion 22*b*. The first cam angle sensor 35*a* is positioned higher than the first ignition coil device 24*a* positioned highest among the plural ignition coil devices 24*a* to be described. The first cam angle sensor 35*a* is positioned higher than the cable attachment member 26. The first cam angle sensor 35*a* is connected to the ECU 25 through a distribution cable 36*a*. The distribution cable 36*a* is disposed to pass rearwards of the first cylinder portion 22*a*. The distribution cable 36*a* also passes between any adjacent two of the plural ignition coil devices 24*a* (e.g., between the one positioned highest and the one positioned second highest in FIG. 3). On the other hand, a second cam angle sensor 35*b* is attached to the second cylinder portion 22*b*. The second cam angle sensor 35*b* is configured to detect the rotational angle of a cam shaft of the second cylinder portion 22*b*. The second cam angle sensor 35*b* is attached to one of the lateral surfaces of the second cylinder portion 22*b*. The second cam angle sensor 35*b* is positioned higher than the second ignition coil device 24*b* positioned highest among the plural second ignition coil devices 24*b* to be described. Further, the second cam angle sensor 35*b* is positioned higher than the cable attachment member 26. Similarly to the first cam angle sensor 35*a*, the second cam angle sensor 35*b* is connected to the ECU 25 through a distribution cable (not illustrated in the figures).

The plural ignition coil devices 24*a* are attached to the first head cover 23*a*, while the plural ignition coil devices 24*b* are attached to the second head cover 23*b*. Each of the ignition coil devices 24*a* and 24*b* is connected to a spark plug 65 (see FIG. 4) disposed within the cylinder unit 22. The ignition coil devices 24*a* are connected to a battery (not illustrated in the figures) through a distribution cable 41*a*, while the ignition coil devices 24*b* are connected to the battery through a distribution cable 41*b*. The ignition coil devices 24*a* and 24*b* are configured to supply electric power to the spark plugs 65. The ignition coil devices attached to the first head cover 23*a* will be hereinafter referred to as "the first ignition coil devices 24*a*". On the other hand, the ignition coil devices attached to the second head cover 23*b* will be hereinafter referred to as "the second coil devices 24*b*". The plural first ignition coil devices 24*a* are aligned in the vertical direction. Each of the first ignition coil devices 24*a* is connected to the distribution cable 41*a* (hereinafter referred to as "the first distribution cable 41*a*"). As illustrated in FIG. 3, the first distribution cable 41*a* is extended upwards while passing sideward of the plural first ignition coil devices 24*a*. As illustrated in FIG. 2, the first distribution cable 41*a* is further extended rearwards while passing over the engine 5. The first distribution cable 41*a* is connected to the battery. On the other hand, the plural second ignition coil devices 24*b* are aligned in the vertical direction. Each of the second ignition coil device 24*b* is connected to the distribution cable 41*b* (hereinafter referred to as "the second distribution cable 41*b*"). The second distribution cable 41*b* is extended upwards while passing sideward of the plural second ignition coil devices 24*b*. Similarly to the first distribution cable 41*a*, the second distribution cable 41*b* is further extended rearwards while passing over the engine 5. The second distribution cable 41*b* is connected to the battery. The ECU 25 is configured to control power supply to the first ignition coil devices 24*a* and the second ignition coil devices 24*b*.

Figure 4:
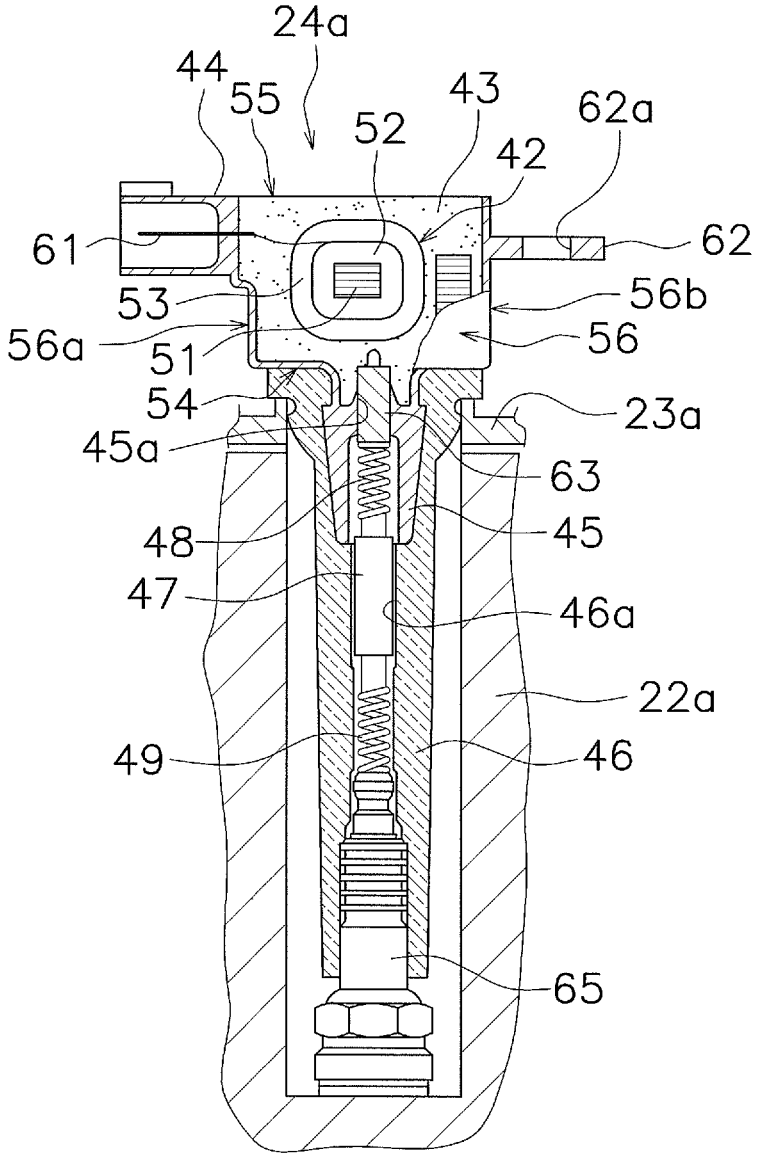
FIG. 4 is a cross-sectional view of an ignition coil device of the engine.

Next, the structures of the ignition coil devices 24*a* and 24*b* will be hereinafter explained in detail. FIG. 4 is a cross-sectional view of the first ignition coil device 24*a*, a portion of the first head cover 23*a* and a portion of the first cylinder portion 22*a*. It should be noted that each second ignition coil device 24*b* preferably has a structure identical to that of each first ignition coil device 24*a*. Therefore, detailed explanation thereof will be hereinafter omitted. Each first ignition coil device 24*a* includes a coil 42, a coil casing 43, a connector portion 44, a high voltage tower 45, a plug boot 46, a resistor 47, a first connecting member 48 and a second connecting member 49.

The coil 42 is configured to transform inputted low voltage into high voltage. The coil 42 includes an iron core 51, a first wound wire 52 and a second wound wire 53. For example, the iron core 51 is made of multilayered laminated tin steel plates. The first and second wound wires 52 and 53 are wound around the iron core 51.

The coil casing 43 is made of insulating resin. The coil casing 43 accommodates the coil 42. The coil casing 43 includes a bottom surface 54, a top surface 55 and lateral surfaces 56. The top surface 55 is positioned on the opposite side of the bottom surface 54. The lateral surfaces 56 connect the bottom surface 54 and the top surface 55. The lateral surfaces 56 include a first lateral surface 56*a* and a second lateral surface 56*b*. The second lateral surface 56*b* is positioned on the opposite side of the first lateral surface 56*a*. The connector portion 44 is connected to the first lateral surface 56*a* of the coil casing 43. The connector portion 44 is integrally formed with the coil casing 43. The connector portion 44 accommodates a low voltage input terminal 51. The low voltage input terminal 61 is connected to the first wound wire 52. Further, the first distribution cable 41*a* is connected to the low voltage input terminal 61. On the other hand, a fixation portion 62 is connected to the second lateral surface 56*b* of the coil casing 43. The fixation portion 62 serves to fix the coil casing 43 to the head cover 23*a* (23*b*). The fixation portion 62 is a rib protruded from the second lateral surface 56*b*. Further, the fixation portion 62 includes a through hole 62*a*. A bolt is inserted into the through hole 62*a* to fix the coil casing 43 to the first head cover 23*a* (23*b*).

The high voltage tower 45 is connected to the bottom surface 54 of the coil casing 43. The high voltage tower 45 includes an opening 45*a* communicated with the inside of the coil casing 43. The opening 45*a* accommodates a high voltage output terminal 63. The high voltage output terminal 63 is connected to the second wound wire 53. The high voltage output terminal 63 is configured to output high voltage to be generated in blocking excitation current from being applied to the second wound wire 53.

The plug boot 46 is disposed within the first head cover 23*a* and the first cylinder portion 22*a*. The plug boot 46 is an example of an inserted portion according to a preferred embodiment of the present invention. The plug boot 46 is connected to the bottom surface 54 of the coil casing 43 and covers the high voltage tower 45. The plug boot 46 is made of insulating elastic material such as rubber. The plug boot 46 includes a through hole 46*a*. The through hole 46*a* is disposed along the axis of the plug boot 46. The through hole 46*a* is communicated with the opening 45*a* of the high voltage tower 45.

Figure 5:
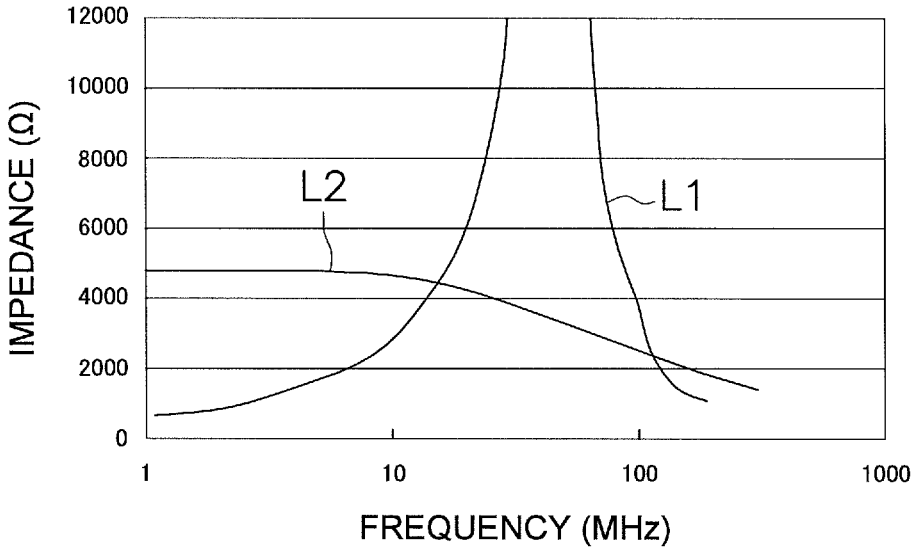
FIG. 5 is a chart representing a frequency characteristic of a resistor of the ignition coil device.

The resistor 47 is disposed within the through hole 46*a* of the plug boot 46. The resistor 47 is a wire wound resistor. In a chart represented in FIG. 5, a line L1 indicates frequency characteristic of the resistor 47. In the chart, the horizontal axis is set as frequency while the vertical axis is set as resistance value (i.e., impedance). As plotted with the line L1 in FIG. 5, the resistor 47 preferably has a peak resistance value (i.e., peak impedance) at a frequency band of greater than or equal to 30 MHz and less than or equal to 80 MHz, for example. Accordingly, the resistor 47 reduces noise radiated from the first ignition coil device 24*a*. The resistor 47 is an example of a radiated noise reducer portion according to a preferred embodiment of the present invention.

The first connecting member 48 is disposed within the through hole 46*a* of the plug boot 46. The first connecting member 48 connects the resistor 47 and the high voltage output terminal 63. The first connecting member 48 is elastically deformable in the axial direction of the through hole 46*a*. For example, the first connecting member 48 is a coil spring. On the other hand, the second connecting member 49 is disposed within the through hole 46*a* of the plug boot 46. The second connecting member 49 connects the resistor 47 and the spark plug 65. The second connecting member 49 is elastically deformable in the axial direction of the through hole 46*a*. For example, the second connecting member 49 is a coil spring. The high voltage output terminal 63 and the spark plug 65 are electrically connected through the first connecting member 48, the resistor 47 and the second connecting member 49.

The outboard motor 1 according to the present preferred embodiment preferably includes the following features.

Figure 6B:
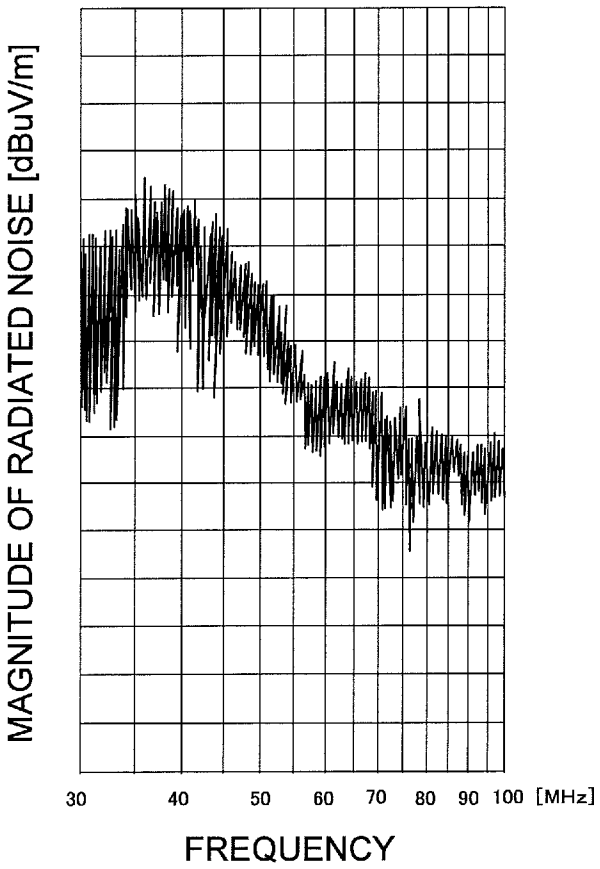
FIGS. 6A and 6B are charts for comparing magnitudes of radiated noise between a preferred embodiment of the present invention and a well-known case.
Figure 6A:
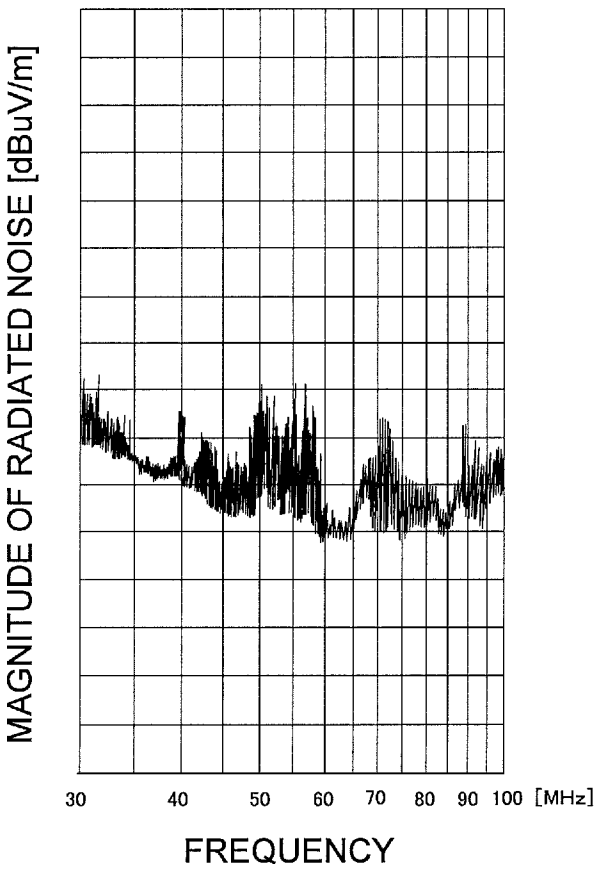

Noise radiated from the ignition coil devices 24*a* and 24*b* can be reduced by embedding the resistor 47 as a noise reducer portion in the ignition coil devices 24*a* and 24*b*. Therefore, the outboard motor 1, including the resin head covers 23*a* and 23*b* and the resin top casing 2, can reduce noise radiated to the outside thereof. FIG. 6A represents a relationship between frequency and magnitude of radiated noise where the resistor 47 of the present preferred embodiment is used. By contrast, FIG. 6B represents a relationship between frequency and magnitude of radiated noise where a well-known resistor is used. The well-known resistor has a frequency characteristic depicted with a line L2 in FIG. 5. It should be noted that the relationship between frequency and magnitude of radiated noise represented in the present preferred embodiment was measured using a measurement technique based on the CISPR12 standard of IEC (International Electrotechnical Commission).

As represented in FIGS. 6A and 6B, magnitude of radiated noise is reduced at a frequency band of greater than or equal to 30 MHz and less than or equal to 60 MHz where the resistor 47 of the present exemplary preferred embodiment is used, compared to where the well-known resistor is used. Magnitude of irradiated noise is herein markedly reduced at a frequency band of greater than or equal to 30 MHz or less than or equal to 40 MHz, for example. Radiated noise at such a low frequency band may have a very significant negative impact on electronic devices such as the ECU 25. According to the outboard motor 1 of the present preferred embodiment, it is thus possible to effectively reduce radiated noise at a frequency band having a very significant negative impact on electronic devices. Further, it is possible to inhibit noise generation itself from the ignition coil devices 24*a* and 24*b*. It is thereby possible to more reliably prevent the other electronic devices from being negatively influenced by radiated noise.

Noise can be reduced using the resistor 47 of a wire wound type. Therefore, an increase in the number of components can be prevented compared to the structure in which another component is added as a noise reducer portion. An increase in the number of component assembling steps can be thereby avoided.

One of the preferred embodiments of the present invention has been explained above. However, the present invention is not limited to the preferred embodiment described above, and a variety of changes can be herein made without departing from the scope of the present invention.

Figure 7:
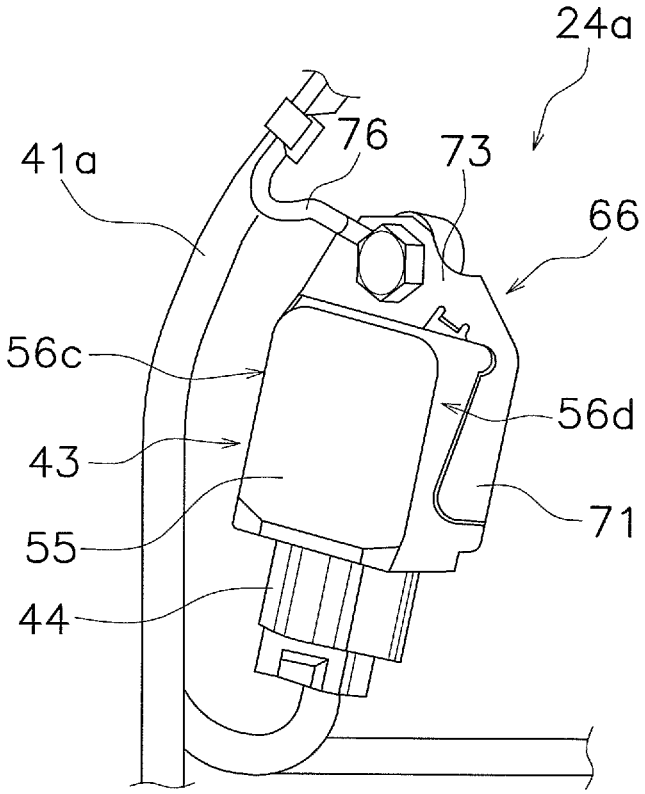
FIG. 7 is a perspective view of an ignition coil device according to another preferred embodiment of the present invention.
Figure 8:
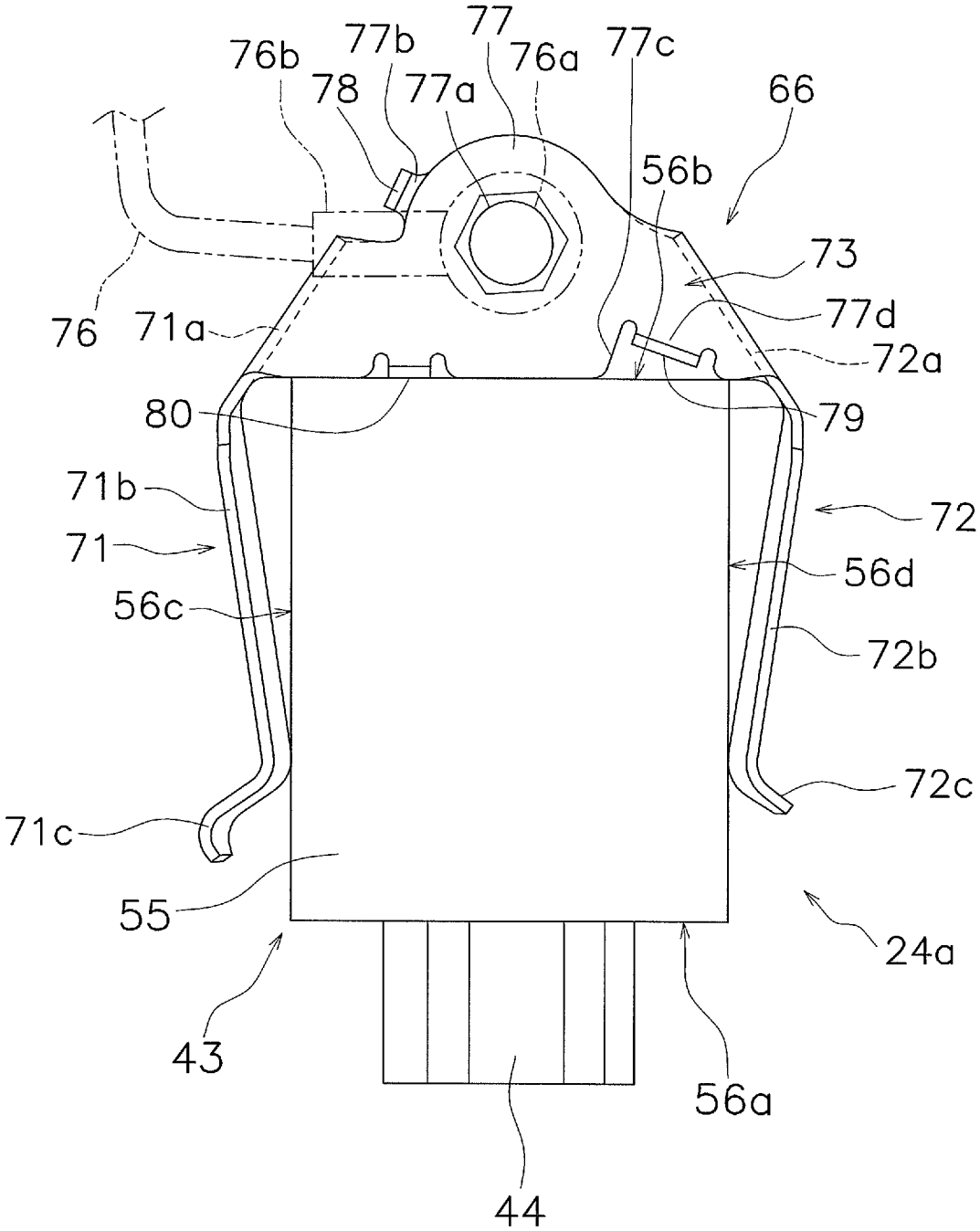
FIG. 8 is a view of the ignition coil device according to another preferred embodiment of the present invention seen from a top surface thereof.

In the preferred embodiment described above, the resistor 47 of a wire wound type is preferably used as the radiated noise reducer portion. However, any other suitable unit for reducing radiated noise may be used instead of the resistor 47. As illustrated in FIGS. 7 and 8, for instance, a cover member 66 may be used as the radiated noise reducer portion. FIG. 7 is a perspective view of each first ignition coil device 24*a*. FIG. 8 is a view of each first ignition coil device 24*a* seen from the top surface 55. It should be noted that each second ignition coil device 24*b* includes the cover member 66 as the radiated noise reducer portion similarly to each first ignition coil device 24*a* although the structure is not illustrated in the figures.

The cover member 66 is a metal member to cover at least a portion of the coil casing 43. The cover member 66, illustrated in FIGS. 7 and 8, covers the lateral surfaces 56 of the coil casing 43. The lateral surfaces 56 herein further includes a third lateral surface 56*c* and a fourth lateral surface 56*d* in addition to the first and second lateral surfaces 56*a* and 56*b*. The third lateral surface 56*c* connects one end of the first lateral surface 56*a* and one end of the second lateral surface 56*b*. The fourth lateral surface 56*d* connects the other end of the first lateral surface 56*a* and the other end of the second lateral surface 56*b*. The cover member 66 covers the third lateral surface 56*c* and the fourth lateral surface 56*d*. Specifically, the cover member 66 covers a portion of the third lateral surface 56*c* and a portion of the fourth lateral surface 56*d*. The cover member 66 has a bent plate shape. As illustrated in FIG. 8, the cover member 66 includes a first cover portion 71, a second cover portion 72 and a coupling portion 73.

It should be noted that "upward" and its related directional terms will hereinafter refer to a direction from the coil-casing bottom surface 54 to the coil-casing top surface 55. Conversely, "downward" and its related directional terms will hereinafter refer to a direction from the coil-casing top surface 55 to the coil-casing bottom surface 54. Further, "forward" and its related directional terms will hereinafter refer to a direction from the second lateral surface 56*b* to the first lateral surface 56*a*. Conversely, "rearward" and its related directional terms will hereinafter refer to a direction from the first lateral surface 56*a* to the second lateral surface 56*b*. In other words, a protruded direction of the connector portion 44 from the coil casing 43 will be referred to as "forward" and its opposite direction will be referred to as "rearward". Yet further, "laterally leftward" and its related directional terms will hereinafter refer to a direction from the third lateral surface 56*c* to the fourth lateral surface 56*d*. Conversely, "laterally rightward" and its related directional terms will hereinafter refer to a direction from the fourth lateral surface 56*d* to the third lateral surface 56*c*.

The first cover portion 71 is a plate shaped portion covering the third lateral surface 56*c* of the coil casing 43. The second cover portion 72 is a plate shaped portion covering the fourth lateral surface 56*d* of the coil casing 43. The coil casing 43 is disposed between the first cover portion 71 and the second cover portion 72. The front end of the first cover portion 71 is an opened end. The front end of the second cover portion 72 is also an opened end. The first cover portion 71 includes a first base portion 71*a*, a first intermediate portion 71*b* and a first tip portion 71*c*. The first intermediate portion 71*b* is positioned forwards of the first base portion 71*a*. The first tip portion 71*c* is positioned forwards of the first intermediate portion 71*b*. In other words, the first intermediate portion 71*b* is positioned between the first base portion 71*a* and the first tip portion 71*c*. On the other hand, the second cover portion 72 includes a second base portion 72*a*, a second intermediate portion 72*b* and a second tip portion 72*c*. The second intermediate portion 72*b* is positioned forwards of the second base portion 72*a*. The second tip portion 72*c* is positioned forwards of the second intermediate portion 72*b*. In other words, the second intermediate portion 72*b* is positioned between the second base portion 72*a* and the second tip portion 72*c*.

The first base portion 71*a* and the second base portion 72*a* are coupled by the coupling portion 73. The first base portion 71*a* and the second base portion 72*a* are transversely separated away from each other. The distance between the first base portion 71*a* and the second base portion 72*a* is gradually reduced to the rearward. In other words, the first base portion 71*a* is slanted so as to be move closer to the coil casing 43 in a rearward direction. The second base portion 72*a* is also slanted so as to be move closer to the coil casing 43 in a rearward direction.

The first intermediate portion 71*b* and the second intermediate portion 72*b* are transversely separated away from each other. The distance between the first intermediate portion 71*b* and the second intermediate portion 72*b* is reduced in the forward direction. In other words, the first intermediate portion 71*b* is slanted to move closer to the coil casing 43 in the forward direction. The second intermediate portion 72*b* is also slanted to move closer to the coil casing 43 in the forward direction. Thus, the coil casing 43 is interposed and held between the first cover portion 71 and the second cover portion 72.

The first tip portion 71*c* and the second tip portion 72*c* are transversely separated away from each other. The distance between the first tip portion 71*c* and the second tip portion 72*c* is increased in the forward direction. In other words, the first tip portion 71*c* is slanted so as to separate away from the coil casing 43 along the forward direction. The second tip portion 72*c* is also slanted so as to separate away from the coil casing 43 along the forward direction. With this structure, the coil casing 43 can be easily inserted between the first tip portion 71*c* and the second tip portion 72*c* during attaching of the cover member 66 to the coil casing 43. It should be noted that the tip of the first tip portion 71*c* is folded towards the third lateral surface 56*c*. Further, the distance between the first cover portion 71 and the third lateral surface 56*c* preferably is less than or equal to about 4 mm, for example. The distance between the second cover portion 72 and the fourth lateral surface 56*d* preferably is also less than or equal to about 4 mm, for example.

As described above, the coupling portion 73 couples the first cover portion 71 and the second cover portion 72. A ground cable 76 is connected to the coupling portion 73. The coupling portion 73 includes a coupling body 77, a first protrusion 78 and a second protrusion 79. The coupling body 77 has a plate shape. The coupling body 77 includes a through hole 77*a*. The through hole 77*a* is positioned to overlap with the through hole 62*a* (see FIG. 4) formed in the fixation portion 62 of the coil casing 43. A bolt is inserted into the through hole 77*a* of the coupling body 77, the through hole 62*a* of the fixation portion 62 of the coil casing 43, and a through hole 76*a* of a terminal 76*b* of the ground cable 76. Accordingly, the cover member 66, the coil casing 43 and the terminal 76*b* of the ground cable 76 are fixed to the first head cover 23*a*.

The first protrusion 78 is upwardly protruded from the coupling body 77. The first protrusion 78 is disposed laterally rightwards of the through hole 77*a* of the coupling body 77. Further, the coupling body 77 includes a first extended portion 77*b* extended laterally rightwards from the rear edge thereof. The first protrusion 78 is formed by upwardly bending the end of the first extended portion 77*b*. On the other hand, the second protrusion 79 is upwardly protruded from the coupling body 77. The second protrusion 79 is disposed laterally leftwards of the through hole 77*a* of the coupling body 77. The second protrusion 79 is disposed forwards of a through hole 77*a* of the coupling body 77. Simultaneously, the second protrusion 79 is disposed forwards of the first protrusion 78. Further, the coupling body 77 includes a recess 77*c* recessed rearwards from the front edge thereof. Yet further, the coupling body 77 includes a second extended portion 77*d* within the recess 77*c*. The second extended portion 77*d* is forwardly extended from the recess 77*c*. The second protrusion 79 is formed by upwardly bending the end of the second extended portion 77*d*. Further, the coupling body 77 includes a folded-back portion 80 for detachment prevention on the front edge thereof.

Figure 9:
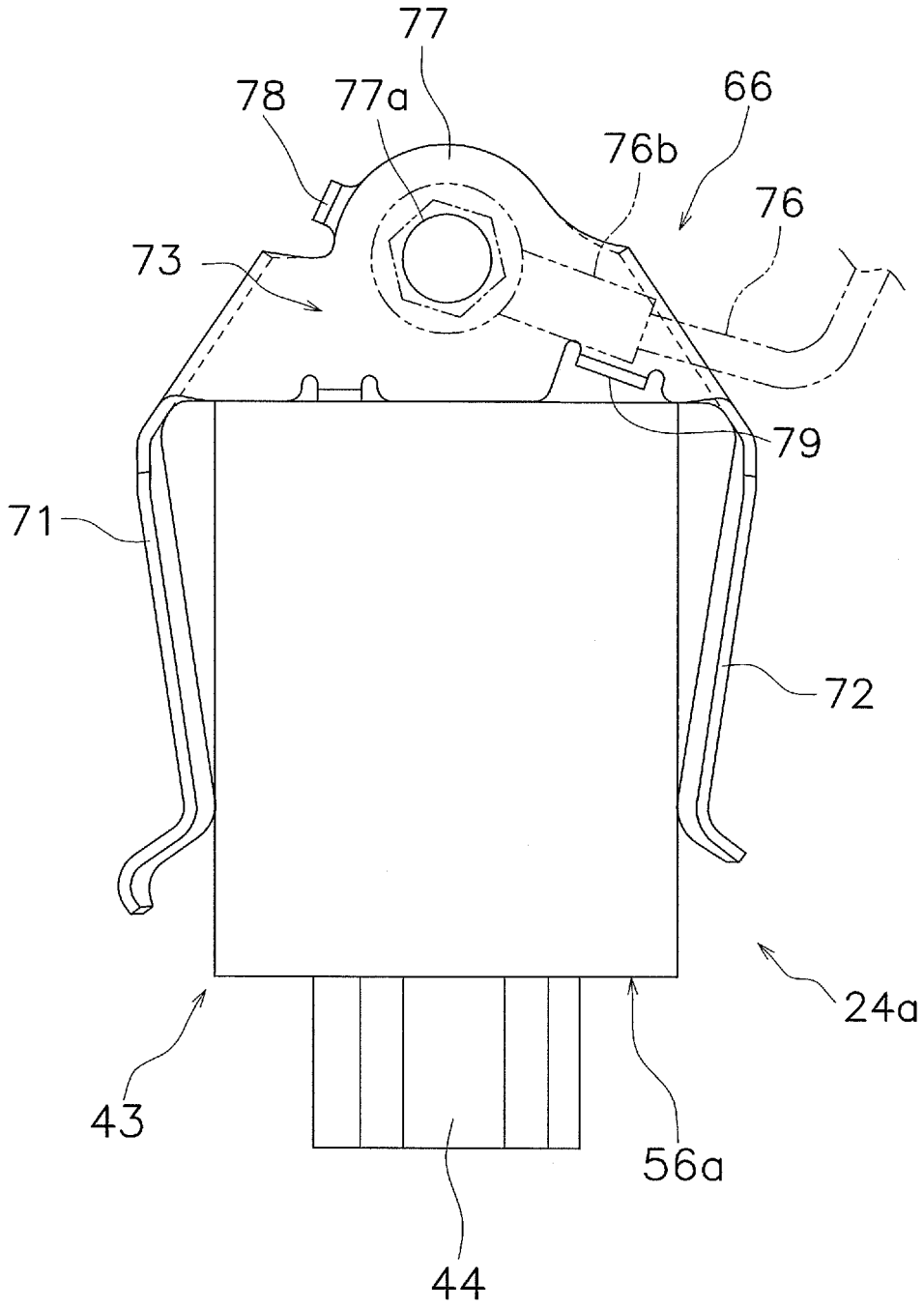
FIG. 9 is a view of the ignition coil device according to another preferred embodiment of the present invention seen from the top surface thereof.

As illustrated in FIG. 8, either of the first protrusion 78 and the second protrusion 79 functions as an anti-rotation member for the terminal 76*b* of the ground cable 76 when the terminal 76*b* is attached to the coupling portion 73. Specifically, the first protrusion 78 serves to prevent rotation of the terminal 76*b* when the ground cable 76 is disposed to extend along a direction from the through hole 77*a* towards the first protrusion 78. As illustrated in FIG. 9, on the other hand, the second protrusion 79 serves to prevent rotation of the terminal 76*b* when the ground cable 76 is disposed to extend along a direction from the through hole 77*a* towards the second protrusion 79.

Figure 10B:
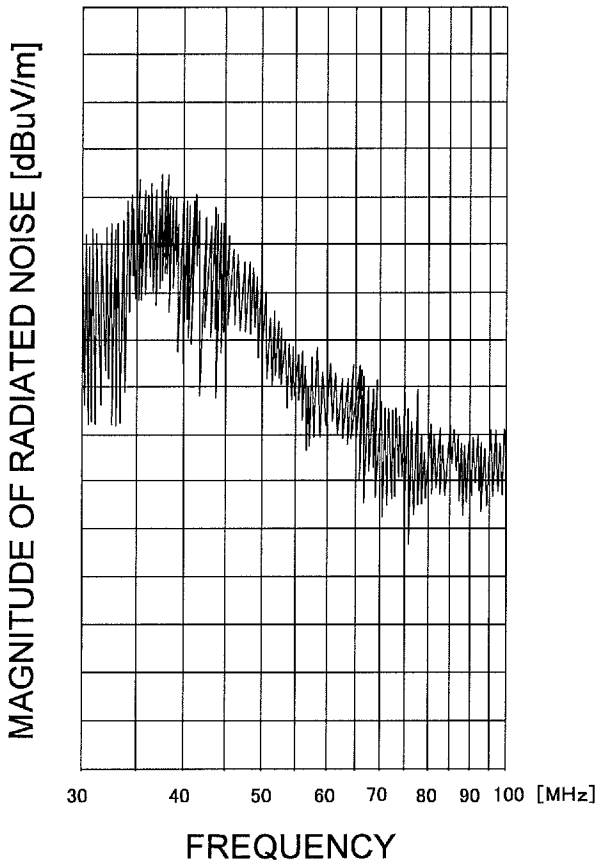
FIGS. 10A and 10B are charts for comparing magnitudes of radiated noise between another preferred embodiment of the present invention and a well-known case.
Figure 10A:
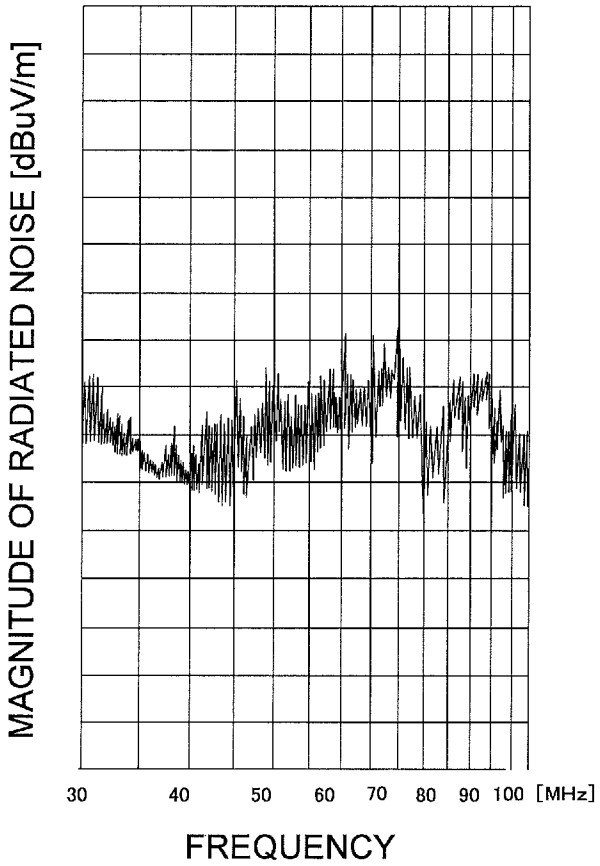

As described above, it is possible to reduce noise radiated from each ignition coil device 24*a*/24*b* by providing each ignition coil device 24*a*/24*b* with the cover member 66 as the noise reducer portion. Accordingly, radiated noise can be reduced in the outboard motor 1 embedded with the resin head covers 23*a* and 23*b* and the rein top casing 2. FIG. 10A represents a relationship between frequency and magnitude of radiated noise where the cover member 66 is used as the noise reducer portion. Similarly to FIG. 6B, FIG. 10B represents a relationship between frequency and magnitude of radiated noise where a well-known resistor is used. As represented in FIGS. 10A and 10B, similarly to where the resistor 47 of the preferred embodiment described above is used, magnitude of noise is reduced at a frequency band of greater than or equal to about 30 MHz and less than or equal to about 60 MHz where the cover member 66 is used, compared to where the well-known resistor is used. Magnitude of noise is herein markedly reduced at a frequency band of greater than or equal to about 30 MHz and less than or equal to about 40 MHz.

Figure 11:
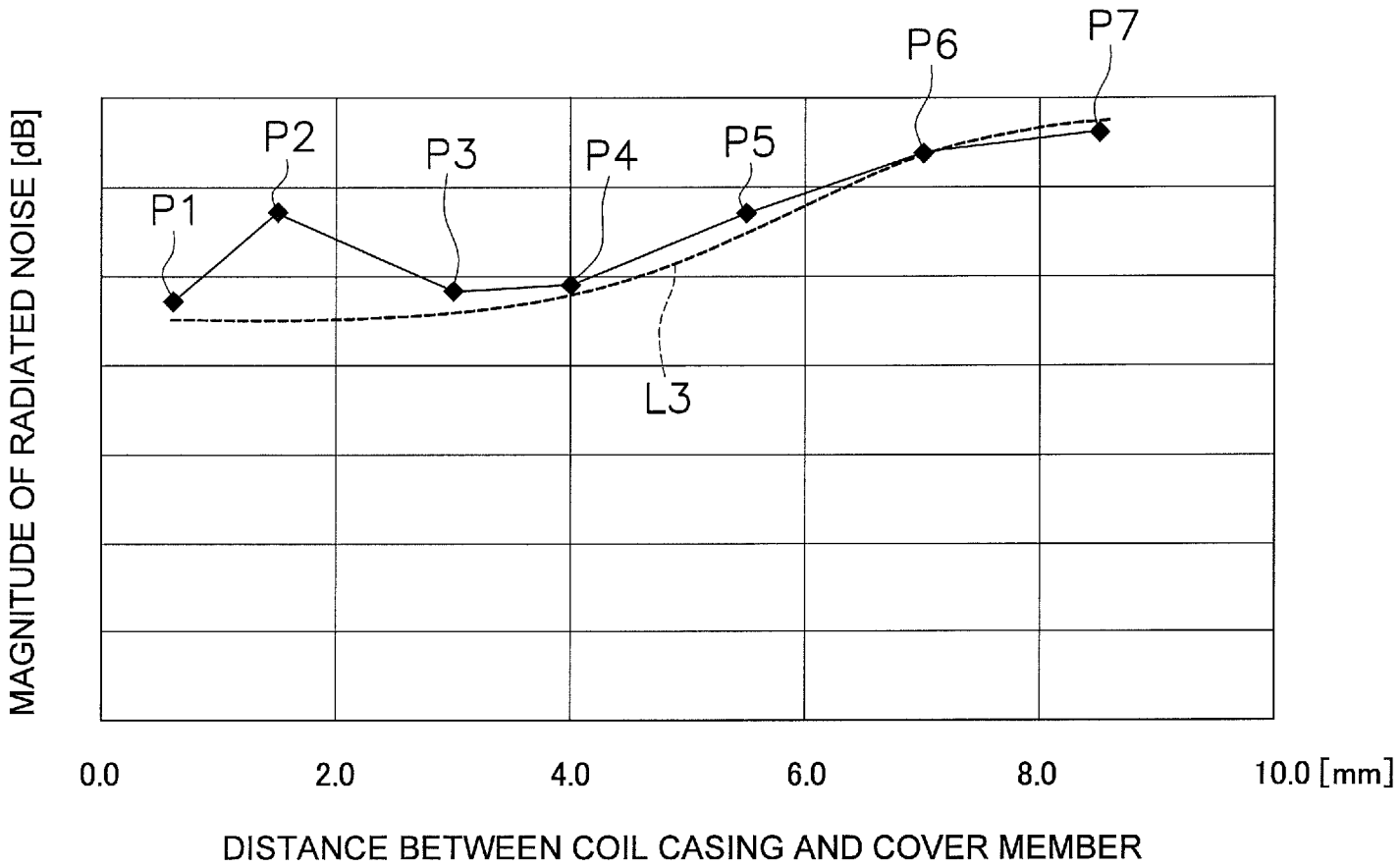
FIG. 11 is a chart representing a relationship between magnitude of radiated noise and distance between a coil casing and a cover member.

FIG. 11 is a chart representing a relationship between magnitude of radiated noise and distance between the coil casing 43 and the cover member 66. A QP (Quasi-Peak) value of radiated noise at a frequency band of greater than or equal to about 30 MHz and less than or equal to about 60 MHz was measured as magnitude of radiated noise with respect to a plurality of samples with different distances between the coil casing 43 and the cover member 66. As a result, an approximated curve (line L3) was obtained based on plots P1 to P7 of measured results in a chart representing the relationship between magnitude of radiated noise and distance between the coil casing 43 and the cover member 66. As can be seen from the line L3, increase in radiated noise is remarkable when the distance between the coil casing 43 and the cover member 66 is greater than about 4 mm, for example. In other words, it is possible to effectively reduce noise radiated from the ignition coil devices 24*a* and 24*b* by setting both of the distance between the first cover portion 71 and the third lateral surface 56*c* and the distance between the second cover portion 72 and the fourth lateral surface 56*d* to be less than or equal to about 4 mm, as described above.

Figure 12:
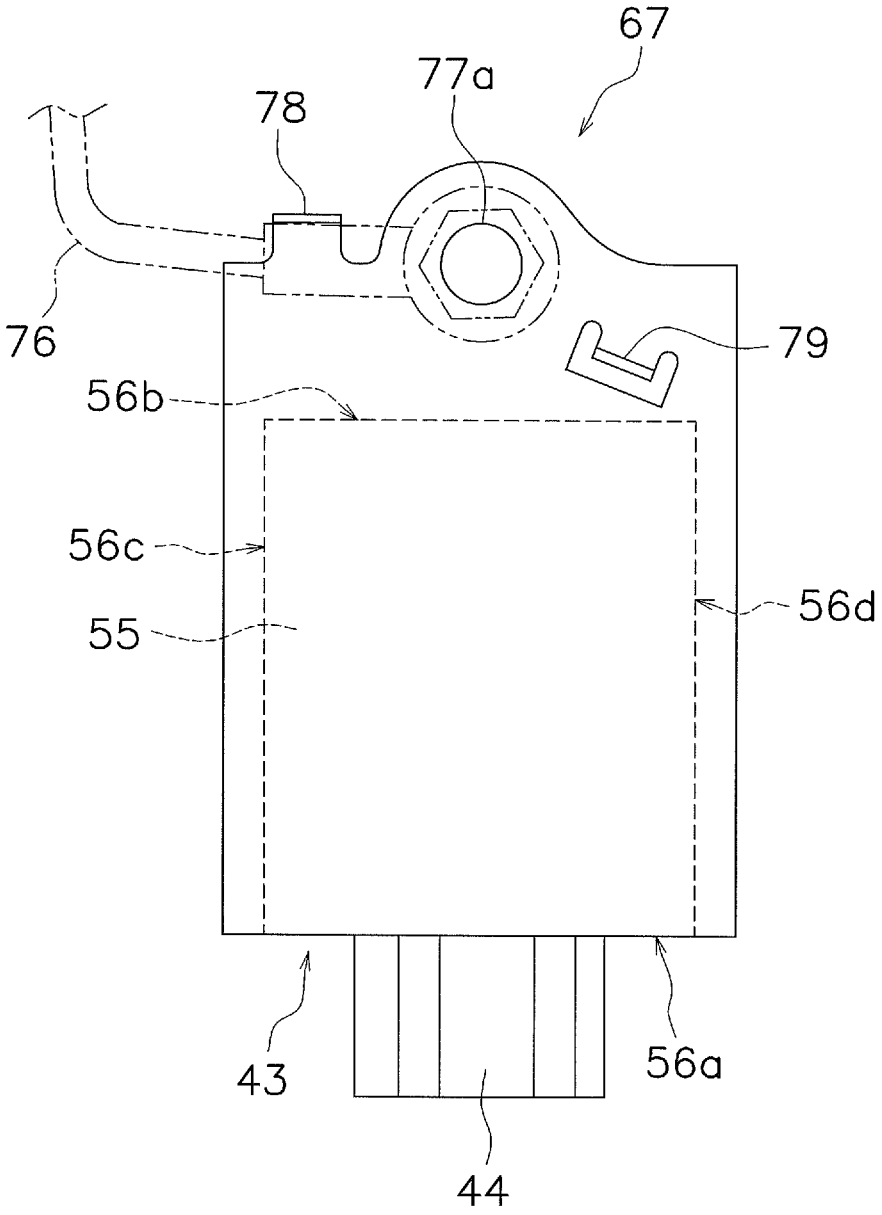
FIG. 12 is a view of an ignition coil device according to yet another preferred embodiment of the present invention.
Figure 13A:
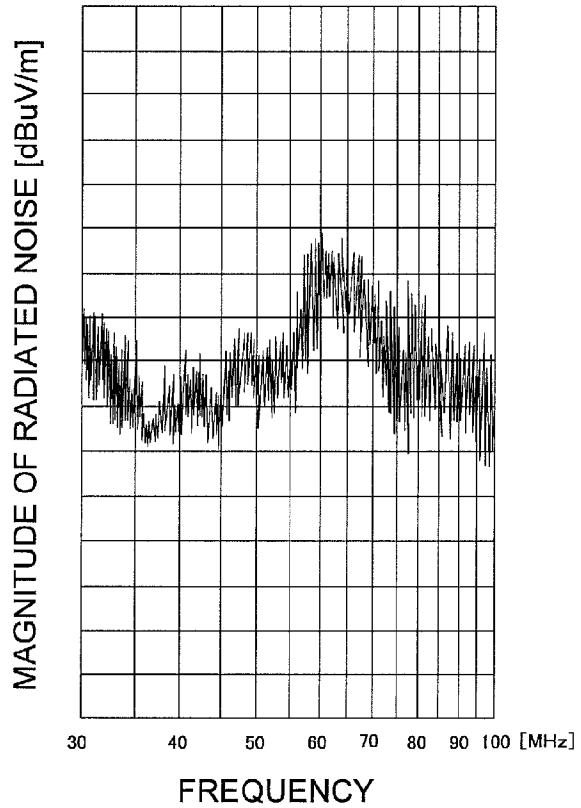
FIGS. 13A and 13B are charts for comparing magnitudes of radiated noise between yet another preferred embodiment of the present invention and a well-known case.
Figure 13B:
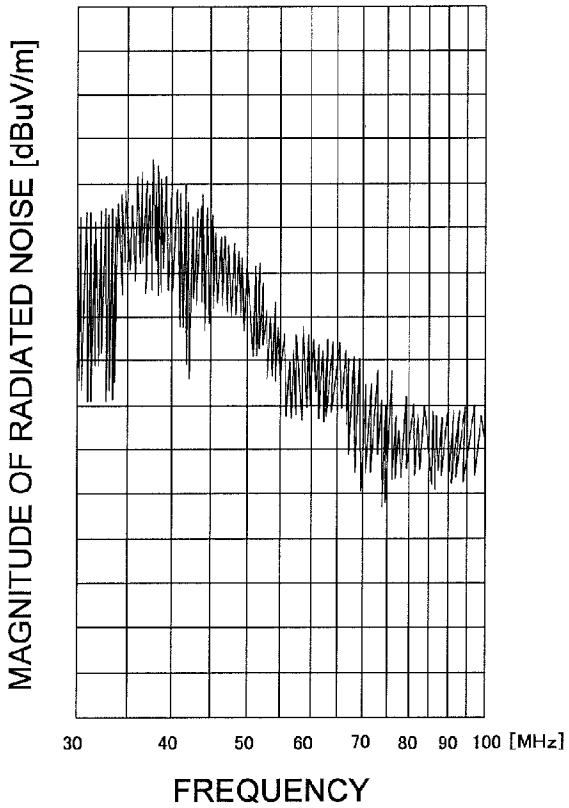

It should be noted that a cover member 67 illustrated in FIG. 12 may be alternatively used as the radiated noise reducer portion. The cover member 67 covers not the lateral surfaces 56 of the coil casing 43 but the top surface 55. FIG. 13A represents a relationship between frequency and magnitude of radiated noise where the cover member 67 is used as the noise reducer portion. Similarly to FIG. 6B, FIG. 13B represents a relationship between frequency and magnitude of radiated noise where a well-known resistor is used. As represented in FIGS. 13A and 13B, similarly to where the resistor 47 is used, magnitude of noise is reduced at a frequency band of greater than or equal to about 30 MHz and less than or equal to about 60 MHz where the cover member 67 is used, compared to where the well-known resistor is used. Magnitude of noise is herein markedly reduced at a frequency band of greater than or equal to about 30 MHz and less than or equal to about 40 MHz.

Figure 14:
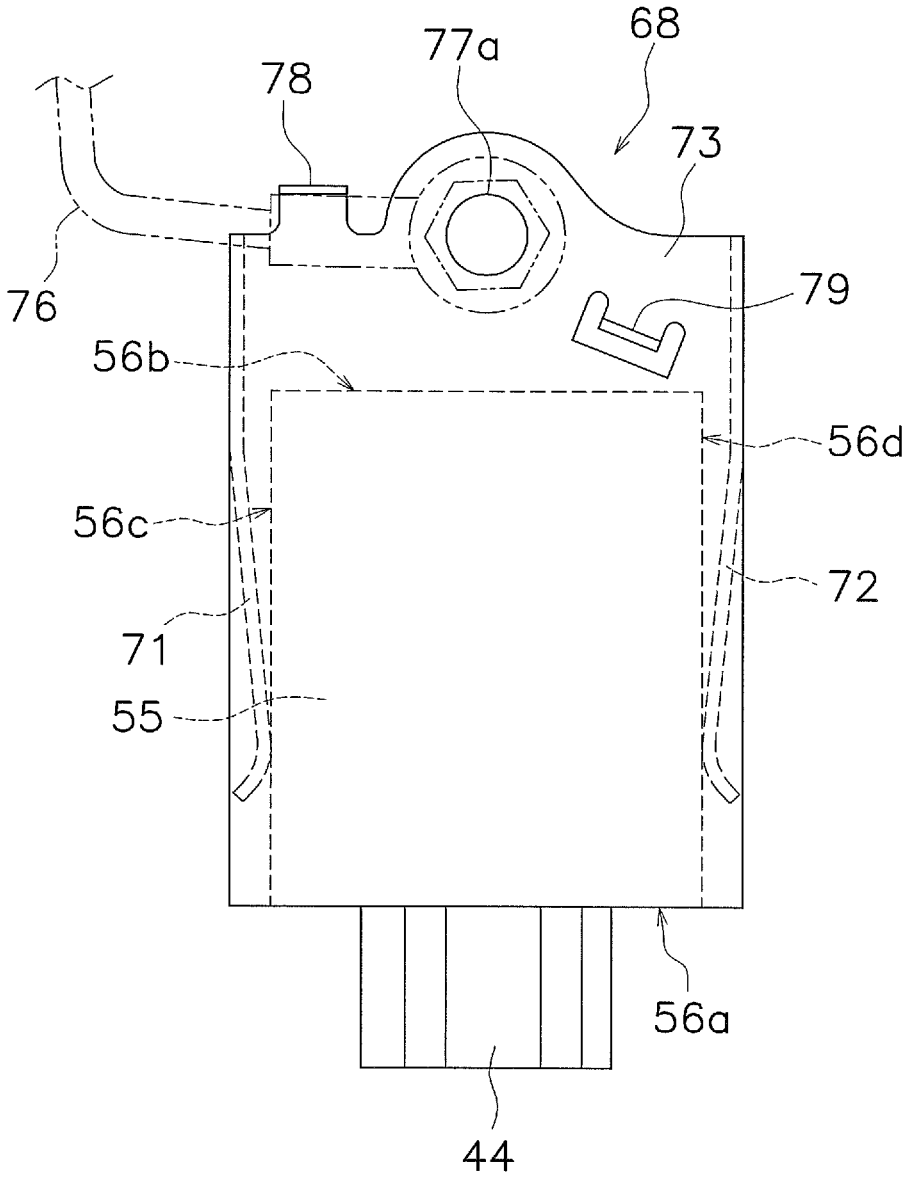
FIG. 14 is a view of an ignition coil device according to a further preferred embodiment of the present invention.

Further alternatively, a cover member 68 illustrated in FIG. 14 may be used as the radiated noise reducer portion. The cover member 68 covers both the top surface 55 and the lateral surfaces 56 of the coil casing 43.

In the preferred embodiments described above, either the resistor 47 or the cover members 66 to 68, as the radiated noise reducer portion, reduce noise at a frequency band of greater than or equal to about 30 MHz and less than or equal to about 60 MHz. However, the radiated noise reducer portion may be configured to reduce noise at a frequency band broader than the aforementioned frequency band. Alternatively, the radiated noise reducer portion may be configured to reduce noise at a frequency band narrower than the aforementioned frequency band. For example, the radiated noise reducer portion may be configured to reduce noise at a predetermined frequency band included in a frequency band of greater than or equal to about 30 MHz and less than or equal to about 50 MHz. Further, the radiated noise reducer portion may be configured to reduce noise at a predetermined frequency band included in a frequency band of greater than or equal to about 30 MHz and less than or equal to about 40 MHz. Further alternatively, the radiated noise reducer portion may be configured to reduce noise at a predetermined frequency band including a frequency band of less than about 30 MHz. Further alternatively, the radiated noise reducer portion may be configured to reduce noise at a predetermined frequency band including a frequency band of greater than about 60 MHz.

In each of the preferred embodiments described above, the ground cable 76 is connected to the coupling portion 73 of the cover member 66, 67 or 68. However, the ground cable 76 may be connected to the other site except for the cover member 66, 67 or 68. For example, the ground cable 76 may be connected to the first cover portion 71. Alternatively, the ground cable 76 may be connected to the second cover portion 72.

In the preferred embodiments described above, either the resistor 47 or the cover member 66, 67 or 68 is preferably used as the radiated noise reducer portion. However, both of the resistor 47 and the cover member 66, 67 or 68 may be used as the radiated noise reducer portions.

In the preferred embodiments described above, the engine 5 preferably is a V8 engine. However, the cylinder unit 22 is not limited to the V type. Further, the number of the cylinders in the cylinder unit 22 is not limited to eight and may be less than or greater than eight.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine including:

a cylinder unit made of metal including a plurality of cylinders;

a head cover made of resin and attached to the cylinder unit; and a plurality of ignition coil devices attached to the head cover;

a casing made of resin and arranged to cover the engine; wherein each of the plurality of ignition coil devices include:

a coil;

a coil casing made of resin, accommodating the coil, and including a through hole;

a radiated noise reducer portion configured to reduce noise radiated from the ignition coil device, the radiated noise reducer portion including a cover member made of metal, arranged to cover at least a portion of the coil casing, and including a through hole; and a ground cable including a terminal connected to the cover member, the terminal including a through hole; wherein the cover member, the coil casing, and the ground cable are fixed to the head cover by a bolt extending through the through hole of the cover member, the through hole of the coil casing, and the through hole of the terminal of the ground cable;

the plurality of the cylinders are aligned in a vertical direction; and the ignition coil device and the cover member are aligned in the vertical direction and provided to each of the plurality of the cylinders.

2. The outboard motor according to claim 1, wherein the ignition coil device further includes a coil and a coil casing made of resin, the coil casing accommodating the coil.

3. The outboard motor according to claim 2, wherein the cover member is grounded.

4. The outboard motor according to claim 2, wherein the ignition coil device further includes an inserted portion disposed within the head cover;

the coil casing includes:

a bottom surface allowing the inserted portion to be connected thereto;

a top surface positioned on an opposite side of the bottom surface; and a lateral surface connecting the top surface and the bottom surface; and the cover member covers at least the lateral surface of the coil casing.

5. The outboard motor according to claim 2, wherein the ignition coil device further includes an inserted portion to be disposed within the head cover;

the coil casing includes:

a bottom surface allowing the inserted portion to be connected thereto;

a top surface positioned on an opposite side of the bottom surface; and a lateral surface connecting the top surface and the bottom surface; and the cover member covers at least the top surface of the coil casing.

6. The outboard motor according to claim 2, wherein the cover member and the coil casing are separated away from each other at a distance of less than or equal to about 4 mm.

* * * * *